US006082912A

United States Patent [19]

Shimizu et al.

[11] Patent Number: 6,082,912

[45] Date of Patent: Jul. 4, 2000

[54] THERMAL PRINTER WITH A MODE CHANGING GEAR

[75] Inventors: Masahiko Shimizu; Ichiro Furuki, both of Tokyo, Japan

[73] Assignee: Mitsubishi Denki Kabushiki Kaisha, Tokyo, Japan

[21] Appl. No.: 09/324,126

[22] Filed: Jun. 2, 1999

[30] Foreign Application Priority Data

Jan. 29, 1999 [JP] Japan ..... 11-023000

[51] Int. Cl.[7] ..... B41J 23/02; B41J 29/393; B41J 33/22

[52] U.S. Cl. ..... 400/120.01; 400/223; 400/236.2

[58] Field of Search ..... 400/223, 225, 400/236.2, 120.01, 614, 88, 185; 347/217, 218

[56] References Cited

U.S. PATENT DOCUMENTS

| | | | |
|---|---|---|---|
| 4,787,762 | 11/1988 | Arai | 400/187 |
| 5,036,338 | 7/1991 | Imai | 400/185 |
| 5,230,574 | 8/1998 | Namekawa | 400/120 |
| 5,793,399 | 8/1998 | Kawakami et al. | 347/104 |
| 5,839,838 | 11/1998 | Hokamura et al. | 400/185 |

FOREIGN PATENT DOCUMENTS 7-76150 3/1995 Japan .

OTHER PUBLICATIONS

Mizushina; Thermal Printer, 7–76150 (additional abstract); Patent Abstracts of Japan, Mar. 1995.

*Primary Examiner*—John S. Hilten
*Assistant Examiner*—Daniel J. Colilla

[57] ABSTRACT

A thermal transfer type printer comprising a sun gear 10 connected (indirectly) with a motor 1, exchanging arms 11, 14 having a pin 13,16 respectively, planet gears 12,15, an exchanging gear having bosses 18,19 and engaging with the planet gear 12, a cam 20, a link mechanism 33, and gears 24–32 which engage with the planet gear 15 when the planet gear 15 comes to a predetermined angle position so as to drive a printing paper feeding mechanism 43,44 and to drive an ink ribbon feeding mechanism 45,46. The procedures of the pressing and separation of the thermal printing head, the feeding of the ink ribbon, and the feeding of the paper, can be carried out using only one motor, though not only web type paper but also sheet type paper are usable.

17 Claims, 10 Drawing Sheets

FIG.5
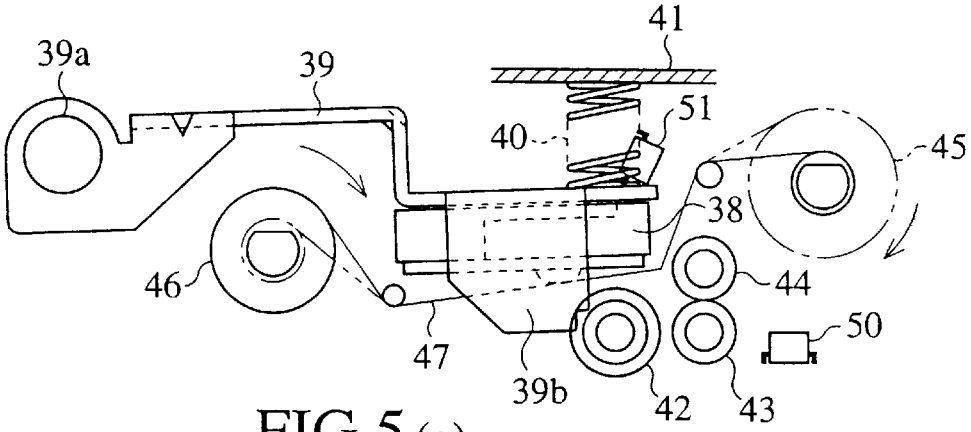
FIG.5 (a)
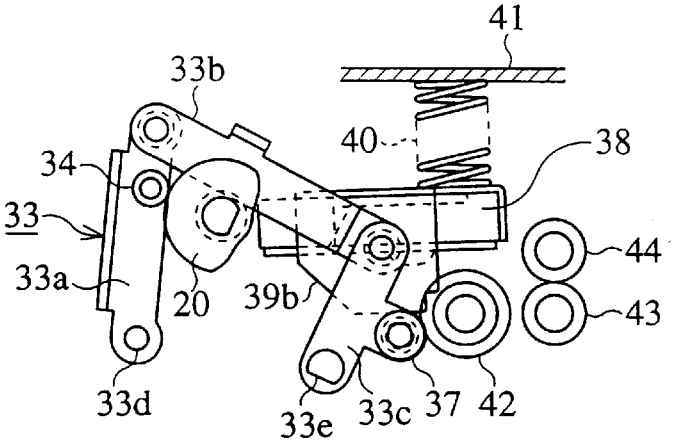
FIG.5 (b)
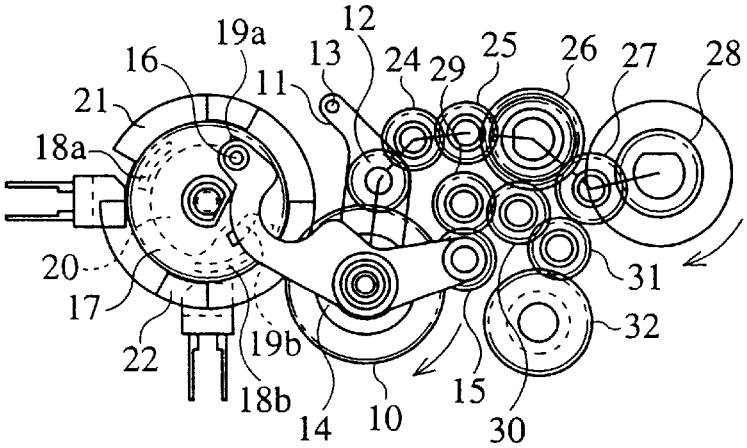
FIG.5 (c)

FIG.7
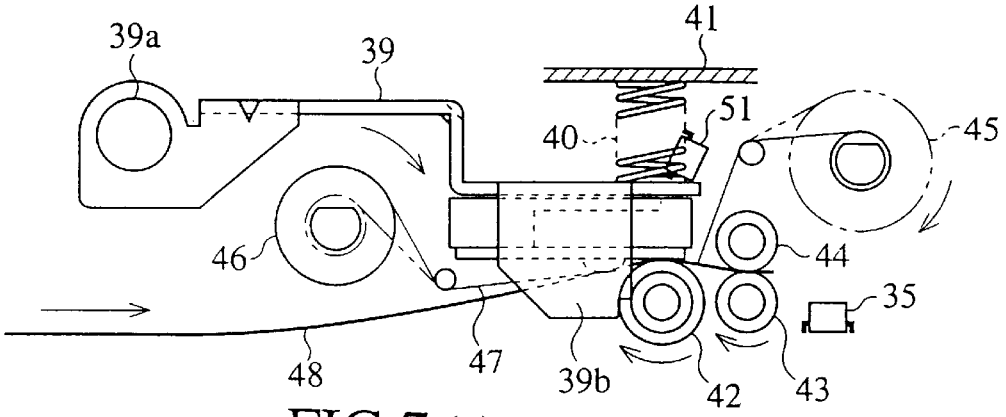
FIG.7 (a)
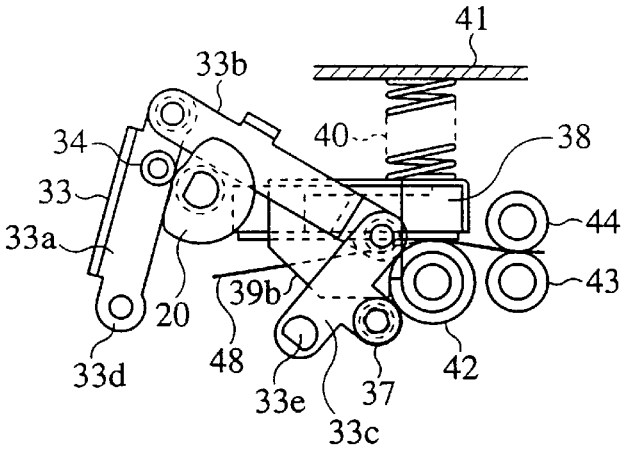
FIG.7 (b)
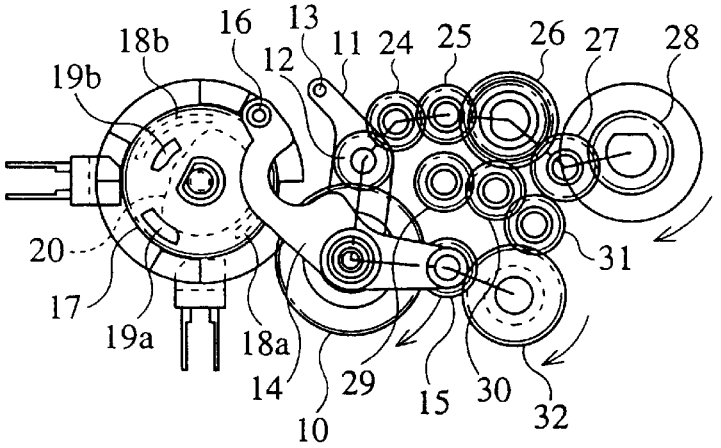
FIG.7 (c)

21
21a
ON→OFF
23a
22
22a
22a
22a
22a
23b
ON→OFF 21
21a
ON
23a
22
22a
ON→OFF
23a 21
21a
ON
23a
22
22a
ON→OFF
23a 21
21a
ON
23a
22
22a
ON→OFF
23a

THERMAL PRINTER WITH A MODE CHANGING GEAR

BACKGROUND OF THE INVENTION

1. Field of the Invention

The present invention relates to a thermal transfer type printer, particularly, relates to a driving system of a thermal transfer type printer, in which, the motion of a thermal printing head to and from the printing paper, the feeding of the printing paper, and the feeding of the ink ribbon are driven by a common motor.

2. Description of the Prior Art

Japanese Patent Application JP-A-7-76150 discloses such a driving system of a thermal transfer type printer in the prior art. FIG. 10 is a side view of the driving system of the thermal transfer type printer of the prior art disclosed in it, showing the initial state (a) and the printing state (b).

Reference numerals 101 denotes a motor gear connected to a motor (not shown), and the reference numeral 102 denotes a transmission gear group. The transmission gear group 102 includes an intermittent gear 102*a* engaging with the motor gear 101, a swing-down gear 102*b*, a swing-up gear 102*c*, a bracket 102*d* rotatable around the rotation axis of the intermittent gear 102*a*, on which the three gears 102*a*, 102*b*, and 102*c* are mounted, and a spring (not shown) disposed between the swing-down gear 102*b* and the bracket so as to form a clutch which transmits torque only when the torque exceeds a predetermined value. They are so arranged that the transmitting gear group as a whole swings around the axis, due to the action and reaction of this spring, according to the rotation of the intermittent gear 102*a*.

Reference numeral 103 denotes a cam gear. The cam gear 103 includes grooves 103*a*, 103*b*, which are formed on the peripheral by cutting off the teeth, and a cam groove 103*c* formed on the side face. The cam gear 103 can engage with the swing-down gear 102*b* and the swing-up gear 102*c*. However, the cam gear 103 can cut off the transmission of torque, when the swing-down gear 102*b* falls into the groove 103*b* and the swing-up gear 102*c* falls into the groove 103*b*.

Reference numeral 104 denotes a head arm, which can pivot around an arm axis 104*b*. One end of the head arm 104 contacts with a cam shaft 104*a*, and the other end of the head arm 104 contacts with a thermal printer head 106 through a spring (not shown). A head fixing member 105, on which the thermal printer head 106 is fixed, is free-rotatably disposed on the arm axis 104*b*. A plurality of heating elements arranged in the main scanning direction are disposed on the thermal printer head 106. The swing-up gear 102*c* can be connected through a connecting gear 107 to a gear 108, which is connected with a platen roller gear 109. The platen roller gear 109 is fixed to the axis of the platen.

The platen roller gear 109 of the platen roller 110 is connected with a clutch gear 113 of an ink ribbon winding up reel 126 through connecting gears 111, 112. The ink ribbon 123 is supplied from an ink ribbon supplying reel 125 and is wound up by the ribbon winding up reel 126 after passing through a path between the thermal printing head 106 and the platen roller 110.

Web paper 122 is supplied from a rolled web 118, which is a paper wound around a web reel 124. A winding-back gear 120 is disposed co-axially with the cam gear 103 so that they can rotate separately. However, the winding-back gear 120 can engage with the cam gear 103, when the swing-up gear 102*c* falls into the groove 103*b*. Namely, the rolled web 118 can be driven to rotate by the core gear 119, when it engages with the cam gear 103 through the winding-back gear 120.

The function of the thermal transfer type printer of this prior art is explained below.

When the motor gear 101 rotates in the normal direction (clockwise in the figure) starting from the state shown in FIG. 10(*a*), the transmission gears 102 rotate as a whole in the reverse direction (counter clockwise) so that the cam gear 103 engages with the swing-down gear 102*b*. Now, the bracket 102*d* of the transmission gears cannot rotate counter clockwise. And the swing-down gear 102*b* begins to rotate clockwise, resisting a resilient force of a spring (not shown).

The cam gear 103 rotates counter clockwise, due to the engagement with the swing-down gear 102*b*. Then the cam shaft 104*a* of the head arm 104 moves along the cam groove 103*c* from an inner position to an outer position in the side face of the cam gear 103. According to this movement of the head arm 104, the thermal printing head 106 approaches towards the platen roller 110, pivoting around the arm axis 104*b*.

The thermal printing head 106 contacts with the platen roller 110, then a spring (not shown) disposed between the head arm 104 and the head fixing member 105 presses the thermal printing head 106. The cam gear 103 rotates until the swing-down gear 102*b* falls into the groove 103*a*.

When the swing-down gear 102*b* falls into the groove 103*a*, the rotation of the cam gear 103 stops. In this state, the swing-up gear 102*c* is engaging with the gear 107. In this state, so-called "head down state", the power is transmitted through the gear 107, gear 108, platen gear 109 so as to drive the platen roller 110 to rotate counter clockwise.

At this state, the web 122 and the ink ribbon 123 between the platen roller 110 and the thermal printing head are fed and the web paper is printed by heating the thermal printing head. In this process, the clutch gear 113, engaging with the platen gear 109 through the gear 111 and 112, rotates to drive the ink ribbon winding up reel 126 through a sliding clutch. Accordingly, the ink ribbon is wound up around the ink ribbon winding up reel 126 under a predetermined tension.

When the printing finishes, the motor (not shown) rotates in the reverse direction so as to rotate the motor gear 101 counter clockwise. Then the transmission gear group 102 as a whole rotates clockwise, so that the swing-up gear 102*c* separates from the gear 107 and engages with the cam gear 103. According to the further rotation of the motor, the cam gear 103 rotates clockwise so that the head arm 104 moves to the inner position and the thermal printing head 106 separates from the platen roller 110.

The cam gear 103 stops, when the swing-up gear 102*c* falls into the groove 103*a* of the cam gear 103. In this moment, the swing-up gear 102*c* engages with the winding-back gear 120 so that the core gear 119 engaging with the winding-back gear 120 rotates. The printed web 122 is wound back according to the rotation of the rolled web 118, which is fixed to the core gear 119. As a result, the states of the web and the printer come back to the initial state. In case of color printing, these processes are repeated for each color.

Such a thermal printer of the prior art has drawbacks that the thermal printing head 106 separates from the platen roller 110, when the web is wound back. Namely the web 123 is in free state, when it is wound back. As a result, a slip between the thermal printing head 106 and the web 122 occurs for every winding back of the web, which causes a shift of the register in the color printing.

Moreover, the feeding of web is carried out only by the platen roller 110 in the printing procedure, thus, the holding force of the web is small. As a result, a subtle slip between the web 122 and the platen roller 110 occurs during the printing procedure, namely, the feeding amount of the web cannot be exactly controlled.

Further, the thermal printer in the prior art is applicable only to web type paper, and sheet type paper can not be used.

SUMMARY OF THE INVENTION

An object of the present invention is to eliminate the drawbacks of the thermal printer in the prior art.

Another object is to propose a thermal transfer type printer, in which the holding force of paper is improved so that a shift of the register in the color printing can be avoided, and not only web type paper but also sheet type paper is usable, though only a single motor is used for driving a plurality of function groups in the apparatus.

The objects are attained by a thermal transfer type printer according to the present invention, which comprises:

- a thermal printing head having linearly arranged heating elements for heating ink ribbon to transfer ink to a printing paper so as to print on it;
- a platen roller opposing to the thermal printing head;
- a pressing and separation means for pressing and separating the thermal printing head to and from the platen roller through the ink ribbon and the printing paper;
- a printing paper feeding means for feeding forward and back the printing paper;
- and an ink ribbon feeding means for feeding the ink ribbon, wherein further comprising:
  - a mode exchanging means driven by a motor, which exchanges the direction of the torque transmission;
  - a first torque transmission means for transmitting torque to the ink ribbon feeding means through the mode exchanging means;
  - a second torque transmission means for moving the printing paper feeding means to the first direction through the mode exchanging means;
  - a third torque transmission means for moving the printing paper feeding means to the second direction through the mode exchanging means;
  - and a fourth torque transmission means for transmitting torque to the pressing and separation means through the mode exchanging means;
  - wherein the pressing and separation means, the printing paper feeding means, and the ink ribbon feeding means are driven commonly by the motor, and the torque transmission from the motor to them is exchanged by the mode exchange means.

In a thermal transfer type printer in an embodiment of the present invention, the mode exchange means comprises:

- a sun gear driven by the motor to rotate;
- a pair of planet gears engaging with the sun gear so as to rotate around the sun gear;
- an exchanging mechanism comprised of an exchanging gear having bosses on its rotation plane perpendicular to its rotation axis;
- arms connecting each of the planet gear and the rotation axis of the sun gear;
- and pins disposed on the arms;
- wherein the mode exchanging means controls the position of the planet gear around the sun gear, according whether each of the pins and the bosses are contacting or not to each other, the contact and the non-contact of them changes according to the rotation position of the exchange gear.

In a thermal transfer type printer in an embodiment of the present invention, the bosses are formed as arcs having their center at the axis of the exchanging gear.

In a thermal transfer type printer in an embodiment of the present invention, the bosses are disposed on the front surface and on the rear surface of the exchanging gear.

In a thermal transfer type printer in an embodiment of the present invention, the thermal transfer type printer further comprises:

- two sensor plates having recesses at their peripheral portion;
- and a cam for controlling the pressing and separation means;
- wherein the rotation axes of the sensor plates, the cam and the exchanging rear are configured so as to form a co-axial structure and rotate together with each other.

In a thermal transfer type printer in an embodiment of the present invention, the pressing and separation means comprises:

- a link mechanism comprised of three arms;
- a first roller disposed at one of the side arms;
- and a second roller disposed at the other side arm;
- wherein the first roller contacts with an element in the pressing and separation means, the second roller contacts with the cam, so that the pressing and separation can be controlled according to the rotation of the cam.

In a thermal transfer type printer in an embodiment of the present invention, when the motor rotates in the normal direction, a mode of the mode exchange means and a function of the pressing and separation means are selected according to the rotation of the exchange gear, and when the motor rotates in the reverse direction, the second torque transmission means, and the first and second torque transmission means are driven by the motor.

In a thermal transfer type printer in an embodiment of the present invention, one of the planet gears is connected with a gear via a one-way clutch mechanism so that torque is transferred through the gear only in a predetermined rotation direction and is not transferred in the reverse direction.

BRIEF DESCRIPTION OF THE DRAWINGS

FIG. 5 shows the first mode (ink ribbon feeding), 5(*a*) shows a paper feeding state, 5(*b*) shows head up and head down states, and 5(*c*) shows a power exchanging state.

FIG. 7 shows the third mode (printing), 7(*a*) shows a paper feeding state, 7(*b*) shows head up and head down states, and 7(*c*) shows a power exchanging state.

DETAILED DESCRIPTION OF THE PREFERRED EMBODIMENTS

Figure 1:
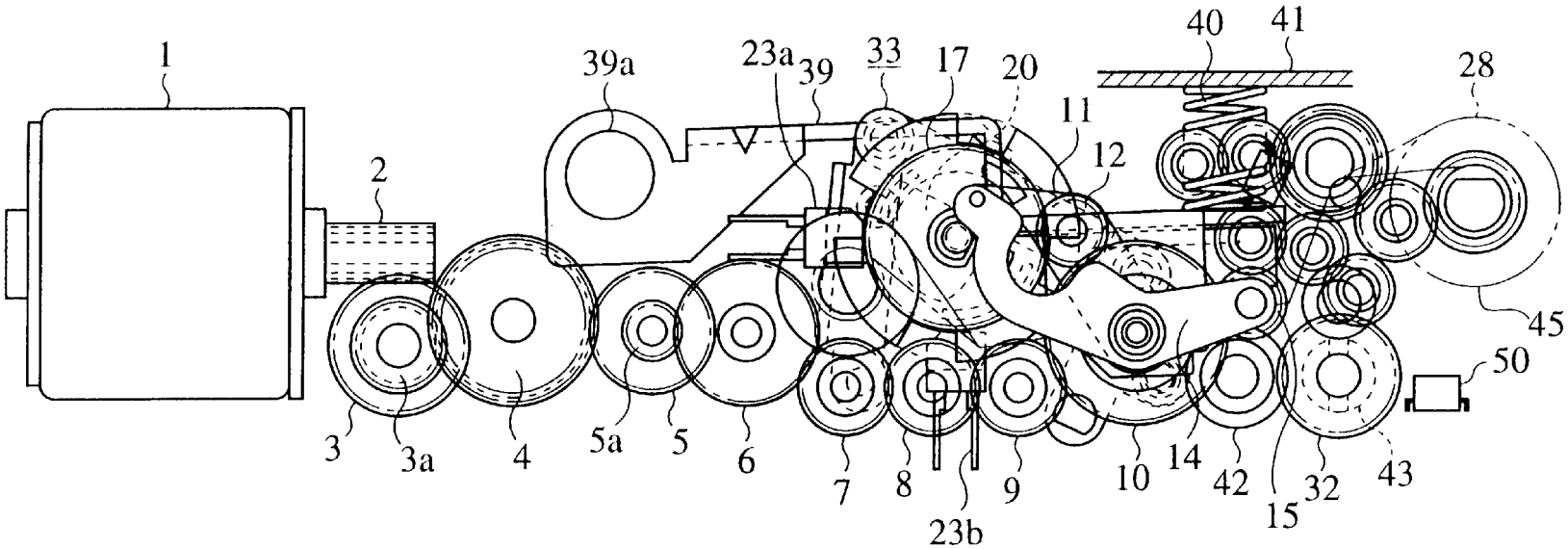
FIG. 1 is a side view of the main part of the driving portion of the exchange mechanism of a thermal transfer type printer as an embodiment 1 of the present invention.
Figure 2:
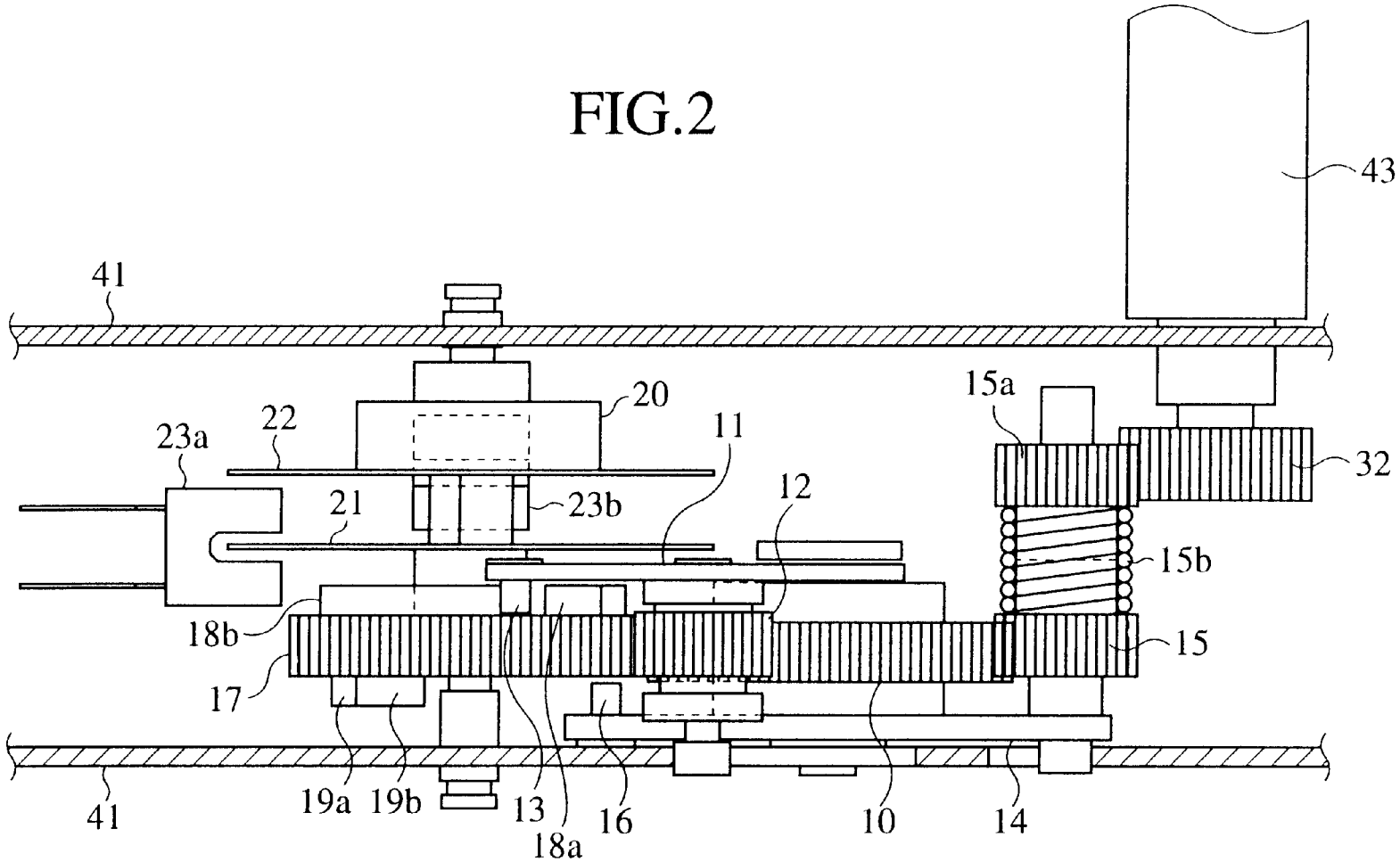
FIG. 2 is a plan view of the driving portion of the exchange mechanism of the printer of FIG. 1.
Figure 3:
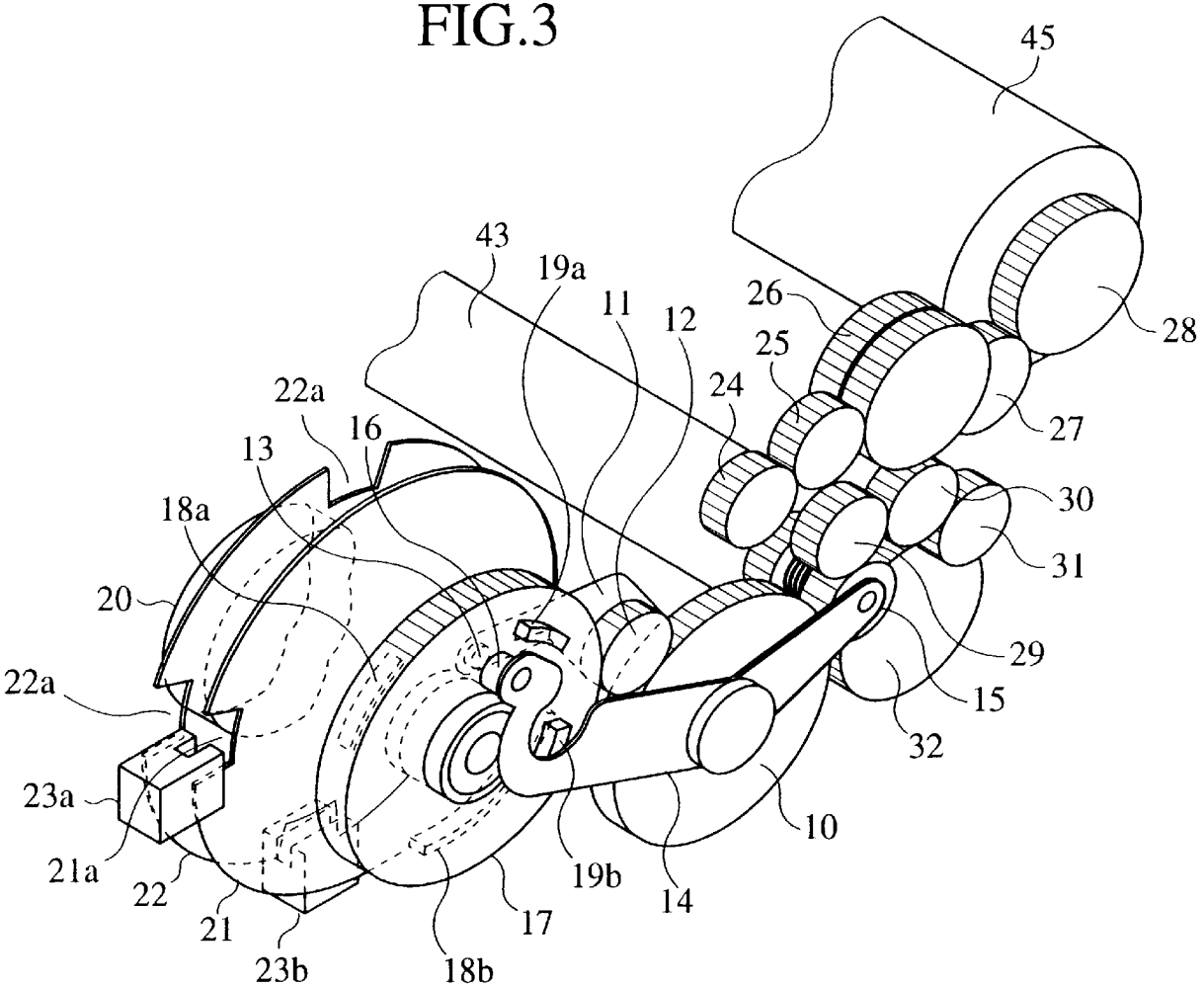
FIG. 3 is a perspective view the driving portion of the exchange mechanism shown in FIG. 2.

An embodiment of the present invention is explained below, referring to FIGS. 1–9.

EMBODIMENT 1

In the figures, reference numeral 1 denotes a motor. A gear 2 is fixed to the shaft of the motor 1. The driving force from the motor is transferred to a sun gear 10 through gears 3 to 9.

A mode exchanging arm 11 is disposed at the rear side of the sun gear 10 and has the same rotation axis as the sun gear 10. A first planet gear 12 is disposed on the mode exchanging arm 11, the planet gear 12 engages with the peripheral gear of the sun gear 10 and moves along the peripheral. A first pin 13, as a projecting portion, is disposed at the tip of the mode exchanging arm 11.

A feeding roller exchanging arm 14 is disposed at the front side of the sun gear 10 and has the same rotation axis as the sun gear 10. A second planet gear 15 is disposed on the feeding roller exchanging arm 14. The second planet gear 15 engages with the peripheral gear of the sun gear 10 and moves along the peripheral. A second pin 16, as a projecting portion, is disposed at the tip of the feeding roller exchanging arm 14.

The sun gear 10 and the mode exchanging arm 11 contact to each other under appropriate friction so that the mode exchanging arm 11 rotates according to the rotation of the sun gear 10 due to the friction. Similarly, the feeding roller exchanging arm 14 rotates according to the rotation of the sun gear 10 due to a friction.

A one-way clutch is formed by the planet gear 15, a gear 15*a* coaxial with the planet gear 15, and a spring 15*b* disposed between them, so that torque is not transferred when the gear 15 rotates clockwise.

An exchanging gear 17 engages with the planet gear 12 so as to be driven to rotate. The exchanging gear 17 has rear bosses 18*a* and 18*b* at the rear side, and front bosses 19*a* and 19*b* at the front side. The rear bosses 18*a* and 18*b* are disposed at different radial positions from the rotation center. Similarly, the front bosses 19*a* and 19*b* are disposed at different radial position.

A cam 20 is fixed to the rotation axis of exchanging gear 17, so that the cam 20 and the gear 17 are driven commonly. The cam 20 extends to the region of the pins 13 and 16, and is formed as a cylinder in the center portion. The position of the cam is fixed by the contact between the pins 13, 16 and the cylinder peripheral. The pins 13, 16 are so arranged that they passes between the cylinder portion of the cam 20 and the rear side bosses 18*a*, 18*b* or between the cylinder portion of the cam 20 and the front side bosses 19*a*, 19*b*, when the exchanging gear 17 rotates.

A main sensor plate 21 for detecting the rotational position is fixed to the exchanging gear 17. The main sensor plate 21 has a recess 21*a* at its peripheral portion. The main sensor plate 21 is arranged in the optical path of a mode detecting sensor 23*a*, which detects whether light can pass through the recess 21*a* or is cut off by the main sensor plate 21.

A sub-sensor plate 22 for detecting the rotational position is fixed to the exchange gear 17 co-axially with the main sensor plate 21. The sub-sensor plate 22 has four recesses 22*a* at its peripheral portion. The sub-sensor plate 22 is arranged in an optical path of a mode detecting sensor 23*b*, which detects whether light can pass through the recess 22*a* or is cut off by the sub-sensor plate 21.

The main sensor plate 21 and the sub-sensor plate 22 are so arranged that the recess 21*a* can align with one of the recess 22*a*. The rotational position of the cam 20 can be identified by the combination of the position of these recesses 21*a*, 22*a*.

A winding up reel 45 is driven by the planet gear 12 through driving gears 24–28, which are driven by the planet gear 12, when the planet gear 12 engages with the driving gear 24, due to a movement of the planet gear 12. A stopper (not shown) contacts with the rotational shaft of the planet gear 12, when the planet gear 12 engages with the gear 12, for preventing the biting of the planet gear 12 into the gear 24.

A torque is transferred to a final ribbon winding up gear 28 through a torque limiter gear 26, which incorporates a mechanism to slip at a torque higher than a predetermined value and does not transfer such an excessive torque.

A grip roller 43 for feeding the printing paper has bosses at its peripheral surface. A grip roller gear 32, which is fixed to the shaft of the grip roller 43, is driven to rotate by the planet gear 15 through gears 29–31. When the planet gear 15 engages with the gear 29, due to an upward movement of the planet gear 15, a rotational torque is transferred from the planet gear 15 to the grip roller gear 32 through the gears 29–31. As a result the grip roller 43 rotates in the direction of paper feeding (counter clockwise in FIG. 4). On the other hand, when the planet gear 15 engages with the gear 32, due to a downward movement of the planet gear 15, the grip roller 43 rotates in the direction of paper winding back (clockwise in FIG. 4).

A stopper (not shown) contacts with the rotational shaft of the planet gear 15, when the planet gear 15 engages with the grip roller gear 32, for preventing the biting of the planet gear 15 into the gear 32.

A thermal printer head 38 is shifted up and shifted down by a link mechanism 33, corresponding to the rotation of the cam 20. Namely the link mechanism 33 is a controller of the pressing and separation of the thermal printing head 38. The link mechanism 33 comprises a left arm 33*a*, a right arm 33*c* and a center arm 33*b* linked with the right and left arms 33*a* and 33*b*. The right arms and the left arm can rotate around a rotation axis 33*d*, 33*e* disposed at their lower portion, respectively. The left arm 33*a* has a cam roller 34, which contacts with the peripheral of the cam 20 and moves along the peripheral of the cam 20. The right arm 33*c* has a shift-up roller 37 for shifting up the thermal printer head 38. The link mechanism 33 is urged towards right in FIG. 4, by a spring (not shown).

The thermal printer head 38 is fixed to a head holder 39, which is an element of a lifting up and down mechanism, namely, it is lifted up and lifted down by the head holder 39, which can swing around a rotation axis 39*a*. The head holder 39 has a contacting portion 39*b* disposed at both the ends regions of the axis of the platen roller 42. By the way, the direction of the axis of the platen roller is the main scanning direction of the thermal printing head 38. The contacting portion 39*b* lifts up the thermal printing head 38, when the contacting portion 39*b* is pushed up by the shift-up roller 37.

A head pressing spring 40 is disposed between a frame 41 of the apparatus and the thermal printing head 38, which pushes down the thermal printing head 38 to pressingly contact with the platen roller 42, when the shift-up roller 37 moves downwards and is separated from the contacting portion 39*b*, due to the leftward movement of the link mechanism 33.

Ink ribbon 47 supplied from a ink ribbon supplying reel 46 passes between the thermal printing head 38 and platen roller 42 and is wound up by a ribbon winding up reel 45. Printing paper 48 is pinched between the grip roller 43 and the pinching roller 44 and is fed between the ink ribbon 47 and the platen roller 42. The leading edge of the printing paper 48 is detected by a paper sensor 50, and the position of color ink in the ink ribbon 47 is detected by a ribbon color sensor 51.

The function of the apparatus in the initial state is explained below.

When the motor 1 begins to rotate in the normal direction, staring from a state, in which the planet gear 12 is engaging with both the sun gear 10 and the exchanging gear 17, the sun gear 10 rotates counter clockwise, due the torque transfer through the motor gear 2 and the gears 3–9. Also the exchanging gear 17, the cam 20, the main sensor plate 21 and the sub-sensor plate 22 rotate in the same direction. The motor 1 stops the rotation, when the main sensor plate 21 and the sub-sensor plate 22 come to the position shown in FIG. 9(*a*).

The planet gear 15 rotates counter clockwise along the peripheral of the sun ear 10, according to the rotation of the sun gear 10, and engages with the gear 29 to rotate clockwise. However the last rotation is not transferred to the gear 29, due to the function of the aforementioned one-way clutch.

In this initial state, the link mechanism 33 is inclined toward left according to the function of the cam 20, hence, the shift-up roller 37 is pushing up the contacting portion 39*b* of the head holder 39, thus the thermal printing head 38 is separated from the platen roller 42.

The function of the apparatus in the first mode (winding up of the ink ribbon) is explained below, referring to FIG. 5.

Figure 4:
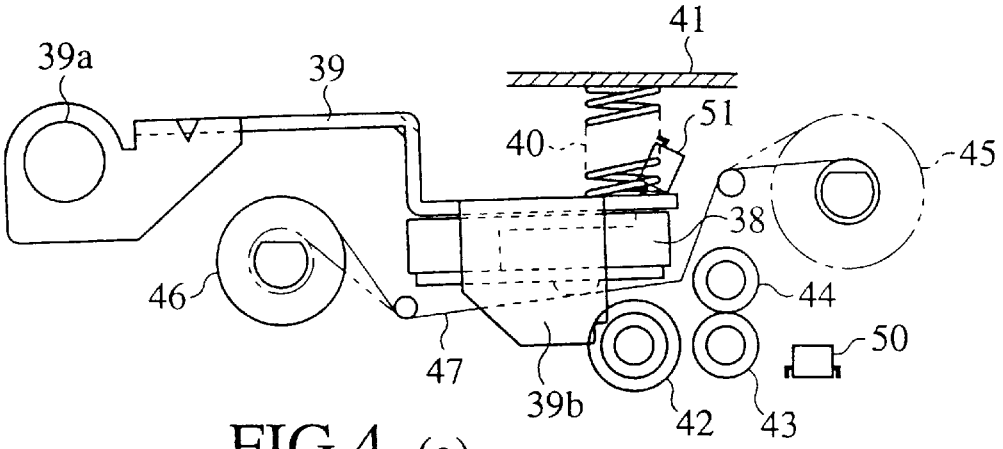
FIG. 4 shows the initial state of the exchange mechanism, 4(*a*) shows a paper feeding state 4(*b*) shows head up and head down states, and 4(*c*) shows a power exchanging state.
Figure 4:
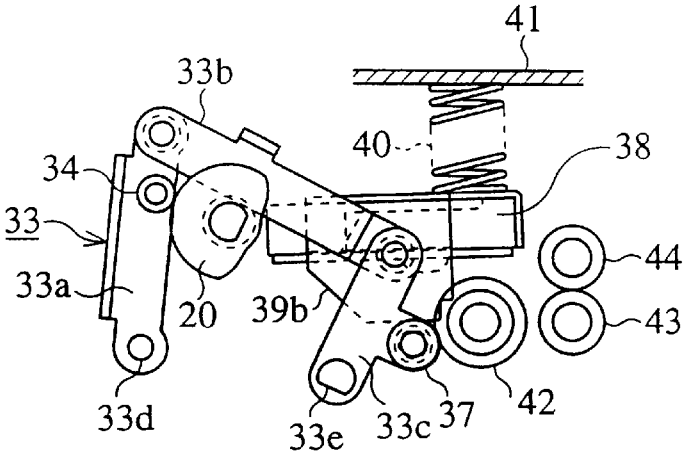
Figure 4:
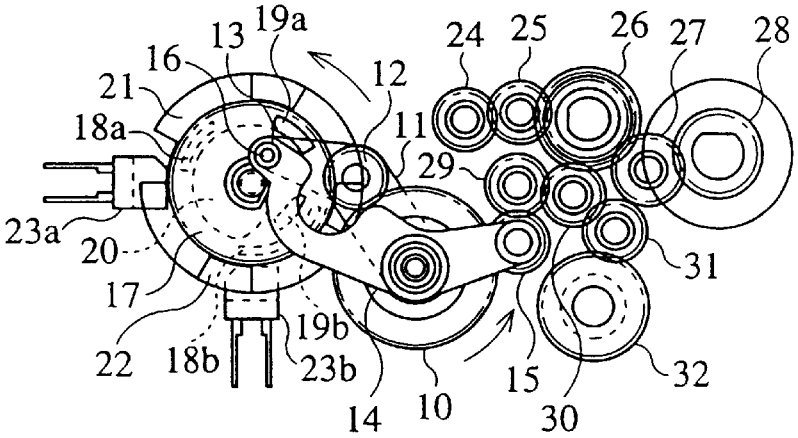

When the motor 1 rotates in the reverse direction, starting from the initial state shown in FIG. 4, the sun gear 10 rotates clockwise. Due to this rotation, the mode exchanging arm 11 and the planet gear 12 moves towards right side, however, the rear bosses 18*a* and 18*b* do not contact with the pin 13, thus, the planet gear 12 engages with the gear 24. As a result, the ink ribbon winding reel 45 rotates clockwise to winding up the ink ribbon 47. The motor 1 stops, when the initial position of the color ink is detected by the color sensor.

The feeding roller exchanging arm 14 and the planet gear 15 tend to rotate clockwise according to the rotation of the sun gear 10, however, the rotations are prevented by the pin 16 disposed at the tip of the feeding roller exchanging arm 14, due to the contact of the pin 16 to the front boss 19*a*. As a result, the planet gear 15 does not engage with the grip roller gear 32.

The function of the second mode (pulling in of the printing paper) is explained below, referring to FIG. 6.

When the motor 1 rotates in the normal direction, starting from a state shown in FIG. 5, the exchanging gear 17 rotates counter clockwise. The motor 1 stops, when the main sensor plate 21 and the sub-sensor plate 22 come to the position shown in FIG. 9(*b*). Then the motor 1 rotates in the reverse direction so that the sun gear 10 rotates clockwise. According the rotation of the sun gear 10, the mode exchanging gear 11 and the planet gear 12 tend to move towards right side, however, the motions are prevented by the pin 13 contacting with the rear boss 18*b* of the exchanging gear 17. Because the mode exchanging gear 11 and the planet gear 12 can not move towards right side, the engagement between the exchanging gear 17 and the planet gear 12 is released in this state.

Similarly, also the feeding roller exchanging arm 14 and the planet gear 15 tend to rotate clockwise according to the rotation of the sun gear 10, however, the rotations are prevented by the pin 16 contacting with the front boss 19*b* of the feeding roller exchanging arm 14. Thus, the planet gear 15 is engaging with the gear 29 in this state. The cam 20 rotates counter clockwise, however, the cam radius does not change in this state, thus, the thermal printing head 38 continues a state separating from the platen roller 44.

By further reverse rotation of the motor 1, the grip roller 43 rotate counter clockwise according to the rotation of the grip roller gear 32. And, when a printing paper 48 is inserted between the grip roller 43 and the pinch roller 44, the paper 48 is introduced between the ink ribbon 47 and the platen roller 42.

After the detection of the end of the paper 48 by the paper sensor 50, the motor 1 stops after a further rotation corresponding to a predetermined pulse number. The paper stops at a state that the end portion of the paper 48 is pinched between the grip roller 43 and the pinching roller 44.

The function of the third mode (printing) is explained below, referring to FIG. 7.

Figure 6:
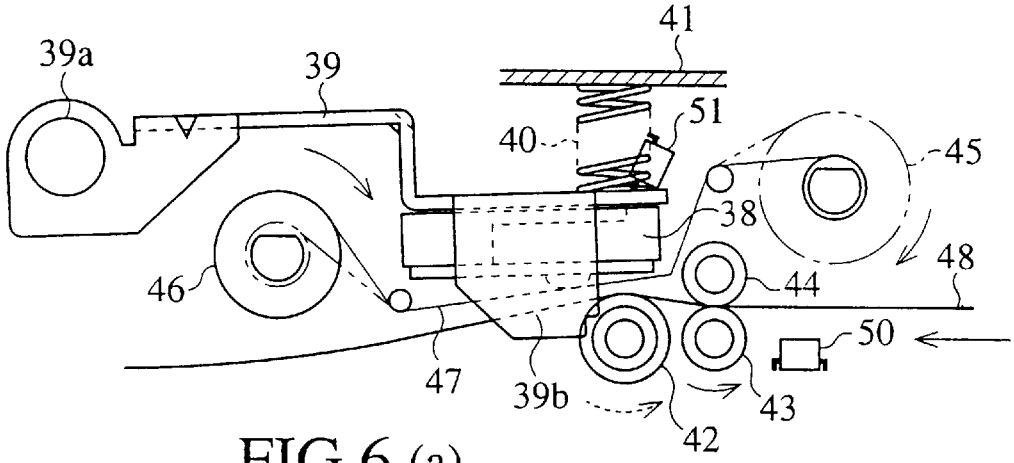
FIG. 6 shows the second mode (paper pulling), 6(*a*) shows a paper feeding state, 6(*b*) shows head up and head down states, and 6(*c*) shows a power exchanging state.
Figure 6B:
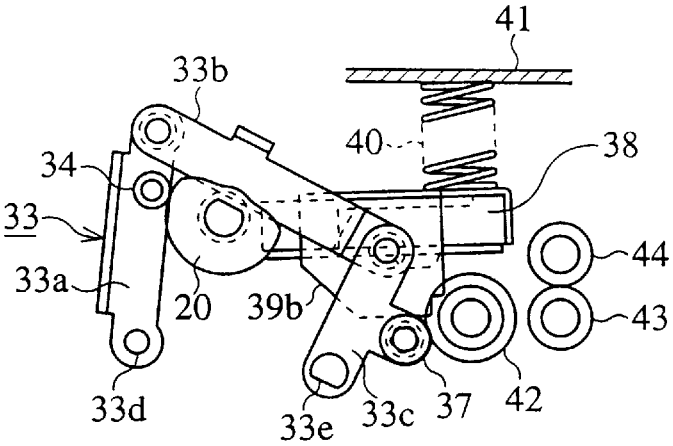
Figure 6:
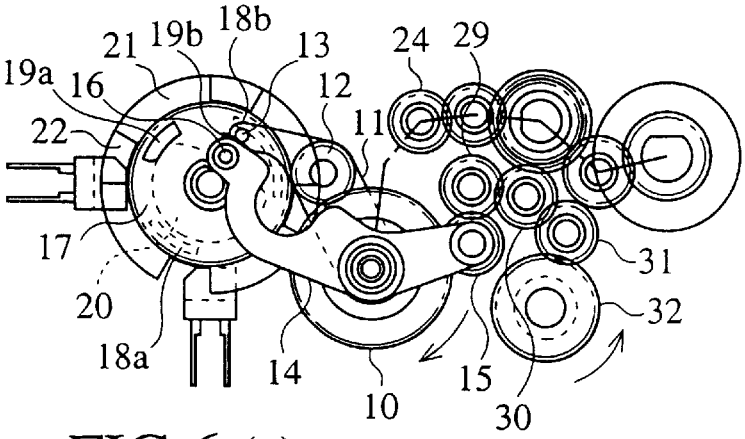

When the motor 1 rotates in the normal direction, starting from the state shown in FIG. 6, the exchanging gear 17 rotates counter clockwise. The motor 1 stops, when the main sensor plate 21 and the sub-sensor plate 22 come to the position shown in FIG. 9(*c*). In this state, the smaller radius portion of the cam 20 contacts with the cam roller 34, thus, the link mechanism 33 inclines towards right side.

Accordingly, the shift-up roller 37 moves down to separate from the contacting portion 39*b* of the head holder 39. As a result, the thermal printing head 38 is pressed to the platen roller 42 through the ink ribbon 47 and the paper 48, due to the resilient force of the head pressing spring 40.

Starting from this state, motor 1 rotates in the reverse direction so that the sun gear 10 rotates counter clockwise. According to the rotation of the sun gear 10, the mode exchanging arm 11 and the planet gear 12 move towards right side. However, the rear bosses 18*a*, 18*b* of the exchanging gear 17 do not contact with the pin 13 in this state, therefore, the planet gear 12 engages with the gear 24. Due to this engagement, torque is transferred to the ribbon winding up gear 28 through the gear 25, torque limiter gear 26 and gear 27, so that the ink ribbon winding reel 45 rotates clockwise.

Simultaneously, due to the rotation of sun gear 10, also the feeding roller exchanging arm 14 and the planet gear 15 moves clockwise so that the planet gear 15 engages with the grip roller gear 32. As a result, the grip roller 43 rotates clockwise so as to feed the paper 48 towards right side.

When the leading edge of the paper 48 transported towards right side is detected by the paper detector 50, the heating of the thermal printing head begins. Namely, a series of printing procedure is carried out to print on the printing paper 48. When a predetermined amount of printing procedure is finished, the rotation of the motor 1 stops.

In case of color printing, the second mode (pulling in of the printing paper) shown in FIG. 6 and the third mode (printing) shown in FIG. 7 are repeated for each color.

Figure 8:
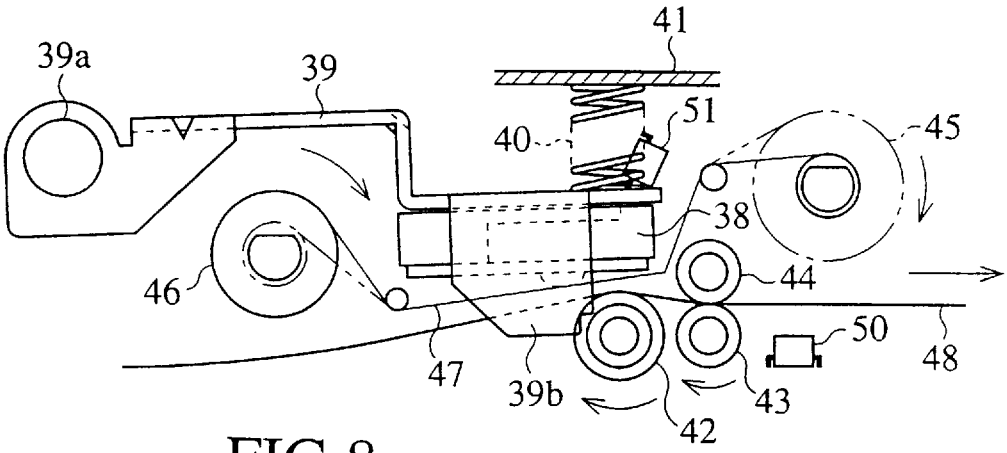
FIG. 8 shows the fourth mode (paper delivery), 8(*a*) shows a paper feeding state, 8(*b*) shows head up and head down states, and 8(*c*) shows a power exchanging state.
Figure 8:
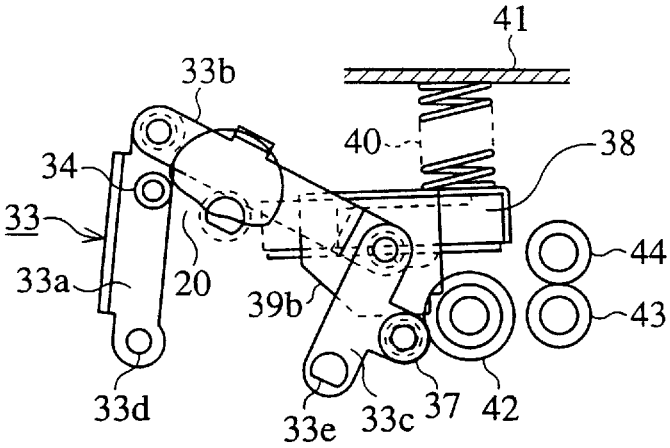
Figure 8:
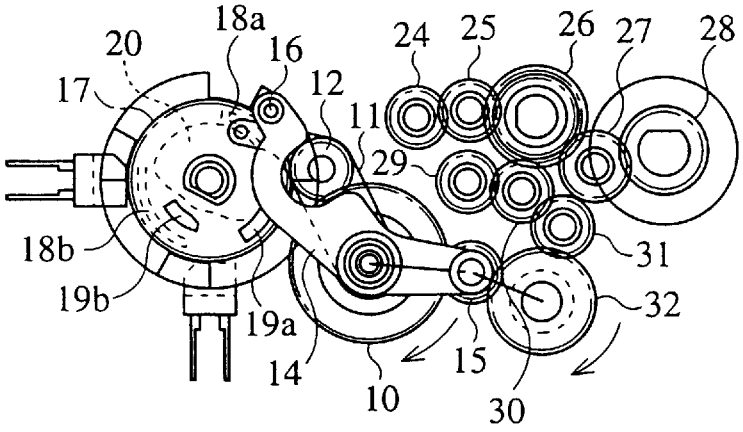
Figures 9A, 9B, 9C, 9D:
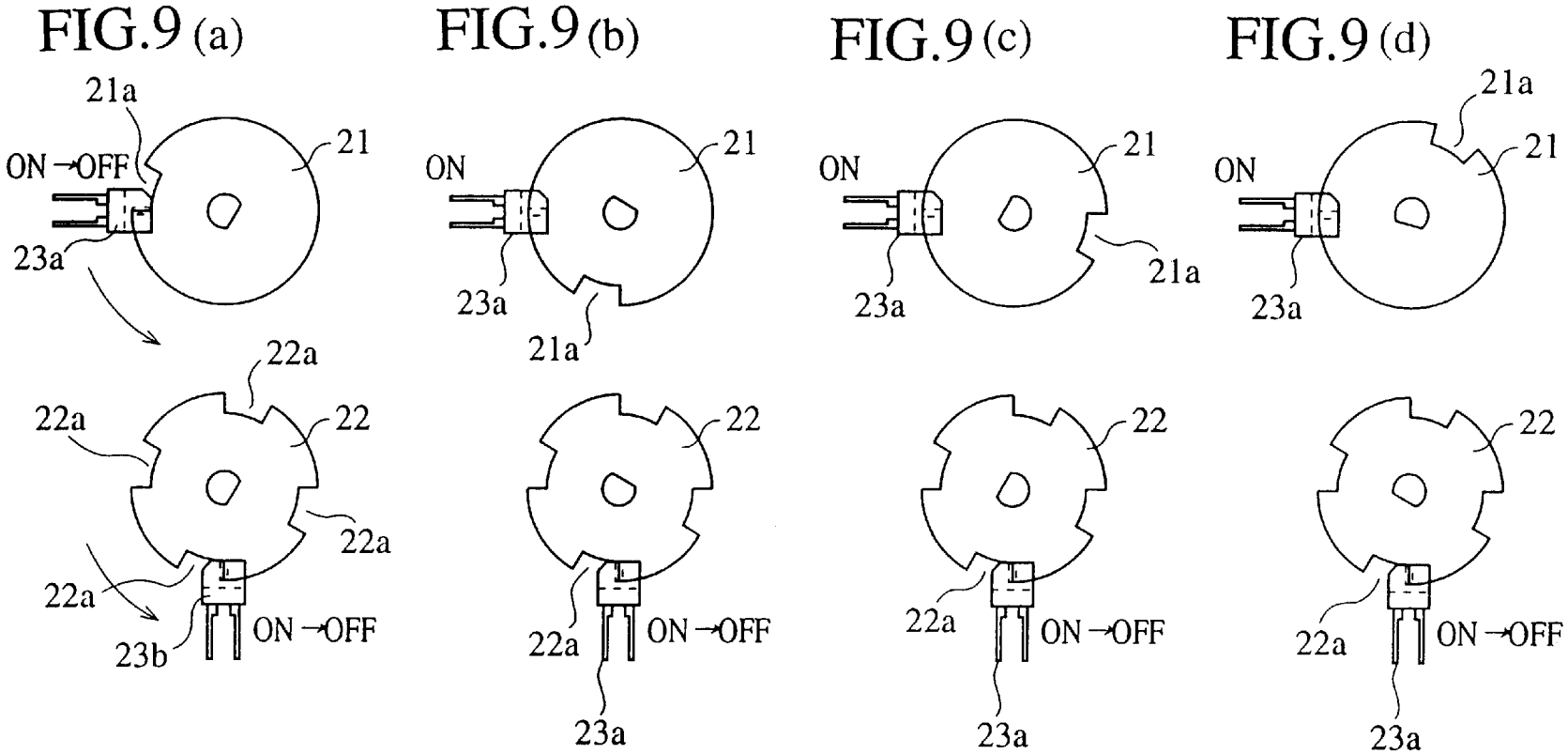
FIG. 9 shows how the mode can be detected for controlling the exchange of the modes. 9(*a*) is the initial state and the first mode (ink ribbon feeding), 9(*b*) is the second mode (paper pulling), 9(*c*) is the third mode (printing), and 9(*d*) is fourth mode (paper delivery).
Figure 10B:
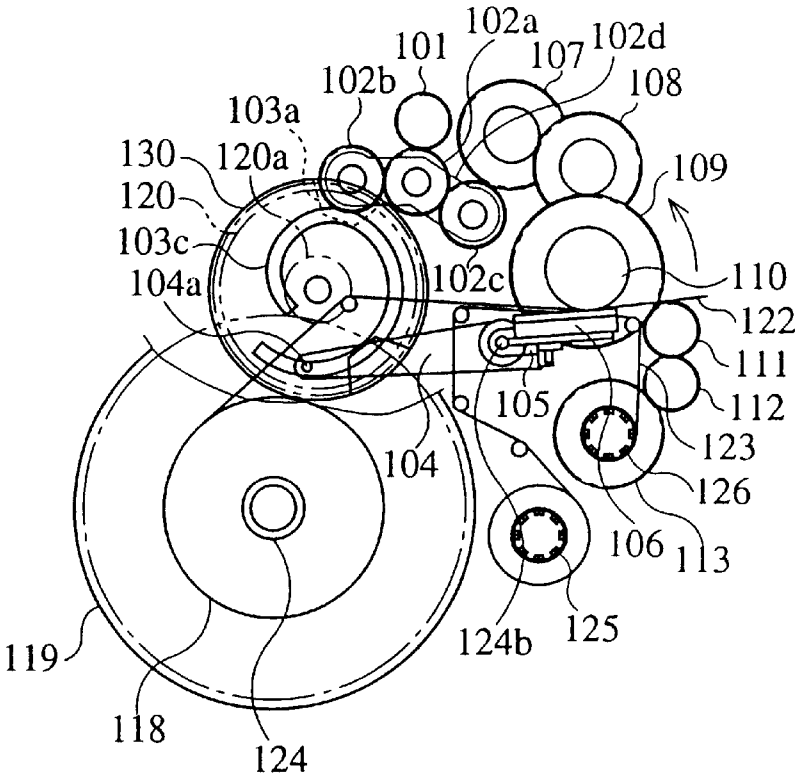
FIG. 10 is a side view of the driving system of the thermal type printer of the prior art. 10(*a*) shows the initial state, and 10(*b*) shows the printing state.
Figure 10A:
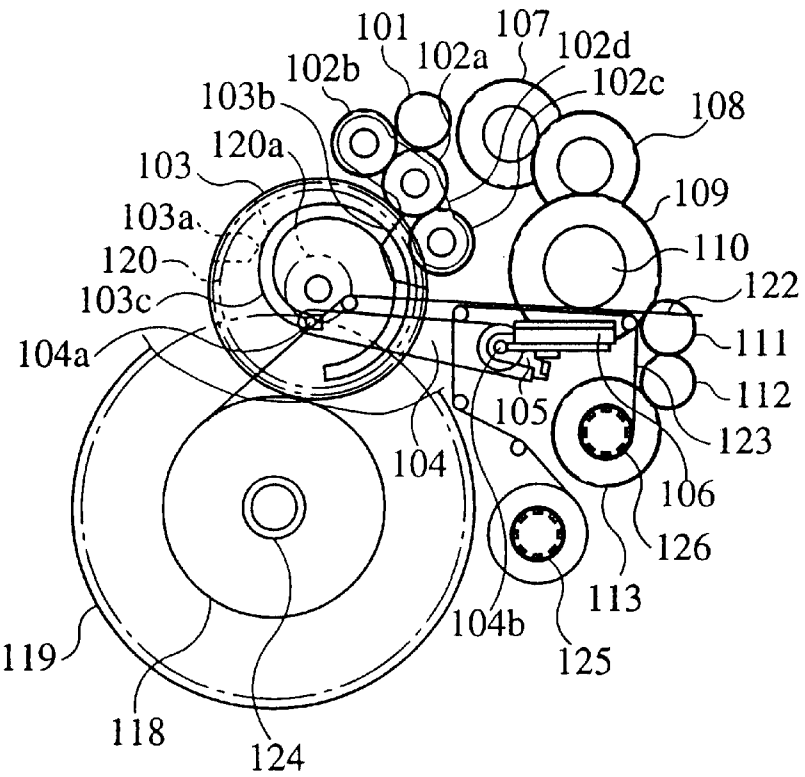

The function of the fourth mode (delivery of paper after one color printing or multi-color printing) is explained below, referring to FIG. 8.

Starting from the state shown in FIG. 7, the motor 1 rotates in the normal direction so that the exchanging gear 17 rotates counter clockwise. The motor 1 stops, when the main sensor plate 21 and the sub-sensor plate 22 come to the position shown in FIG. 9(*d*). In this state the smaller radius portion of the cam 20 contacts with the cam roller 34, thus the link mechanism 33 moves towards left side.

As a result, the sift-up roller 37 moves to push up the contacting portion 39*b* of the head holder 39, therefore, the thermal printing head 38 moves to separate from the platen roller 42.

Then the motor rotates in the reverse direction, so that the sun gear 10 rotates clockwise. According to the rotation of the sun gear 10, the mode exchanging arm 11 and the planet gear 12 tend to move towards right side. However, these motions are prevented by the pin 13 contacting with the rear boss 18*a* of the exchanging gear 17. As a result, the engagement between the exchanging gear 17 and the planet gear 12 is released in this state.

Similarly, due to the rotation of the sun gear 10, the feeding roller exchanging arm 14 and the planet gear 15 rotate clockwise. And the front bosses 19*a*, 19*b* of the exchanging gear 17 do not contact with the pin 16, therefore, the planet gear 15 engages with the grip roller gear 32 so as to rotate the grip roller 43 clockwise.

As a result, the printed paper 48 is transported towards right side. The procedure of the paper delivery finishes, when the paper goes out from the region of the grip roller 43 and the pinch roller 44.

According to this embodiment of the present invention, the movements of the mode exchanging arm 11 and the feeding roller exchanging arm 14, which are respectively connected with the planet gears 12, 15 engaging with the sun gear 10 and rotating around the sun gear, are controlled on the basis of the positions of the bosses 18*a*, 18*b*, 19*a*, 19*b* according to the rotation of the exchanging gear 17, so that the rotation and stopping of the ink ribbon winding reel 45, the feeding of the ink ribbon, the stopping, clockwise rotation and the counter clockwise rotation of the grip roller 43 can be precisely and exactly carried out using a single driving motor 1. This embodiment have advantage that the shifting of register in the color printing can be avoided, though a sheet paper can be used as printing paper.

Because the cam 20 is arranged co-axially with the rotation shaft of the exchanging gear 17, the pressing and separation of the thermal printing head 38 to and from the platen roller 42 can be controlled according to the respective modes.

Because of a structure that the cam roller 34 contacts and moves along the peripheral of the cam 20 and the shift-up roller 37 pushes up the contacting portion 39*b* of the head holder 39, the thermal printing head 38 can be opened upwardly, by turning around the rotation axis 39*a* of the head holder 39, so that a treatment (for example, removal of jamming paper) incidental upon a trouble in the printer, such as jamming of paper, can be easily carried out.

The thermal transfer type printer according to the present invention allows to carry out the procedures of the pressing and separation of the thermal printing head, the feeding of the ink ribbon, and the feeding of the paper, using only one motor. Moreover, the shifting of the register in the color printing can be avoided, though sheet type paper can be used. And the production costs of the thermal transfer type printer can be reduced.

The arms can be easily controlled, with higher positioning preciseness, in case that the bosses are formed as arcs having the center at the axis of the exchanging gear.

It is possible to control simultaneously two arms using only one exchanging gear, in case that the bosses are disposed on the rear surface and on the front surface of the exchanging gear. As a result, the number of fabrication elements can be eliminated. Thus the fabrication cost of the thermal transfer type printer can be reduced.

The detection of the rotation position of the exchanging gear and the control of the cam position can be easily and stably carried out, in case that the rotation position of the exchanging gear is detected by sensor plates having recesses respectively.

The pressing and separation of the thermal printing head is easy, in case that the controller of the pressing and separation comprises a left arm rotatable around a rotation axis, a right arm rotatable around a rotation axis, a center arm pin-connected with the right and left arms, a cam roller, which is disposed on the left arm and contacts with the cam, and a shifting-up roller, which is disposed on the right arm and contacts with the pressing and separation mechanism. In such a case, the treatment incidental upon a jamming of paper is easy.

The mode exchanging can be easily carried out, in case that when the motor rotates in the normal direction, the exchanging gear functions as a selector of the modes of the printing and as a selector of motion of the link mechanism, and when the motor rotates in the reverse direction, the printing paper feeding mechanism and the ink ribbon feeding mechanism are driven by the motor.

It is possible to allow the torque flow in one direction, in case that one of the planet gear has a one-way clutch mechanism.

What is claimed is:

1. A thermal transfer type printer comprising:

a thermal printing head having linearly arranged heating elements for heating ink ribbon to transfer ink to a printing paper so as to print on it;

a platen roller opposite the thermal printing head;

a pressing and separation means for pressing and separating the thermal printing head to and from the platen roller through the ink ribbon and the printing paper;

a printing paper feeder for feeding the printing paper;

and an ink ribbon feeder for feeding the ink ribbon;

a plurality of gears cooperating to provide a plurality of different torque transmission paths associated with corresponding operational modes of the printer;

a first arm and a second arm for changing between the operational modes of the printer by altering an engagement state of the gears; and a mode changing gear having a front surface opposite a rear surface, bosses extending from the front surface and the rear surface for controlling a position and movement of the first and second arms to change the engagement state of the gears.

2. The thermal transfer type printer according to claim 1, further comprising:

a motor;

a sun gear driven by the motor to rotate;

a pair of planetary gears engaging with the sun gear so as to rotate;

the first and second arms extending outward from a rotation axis of the sun gear to provide rotational axes for the pair of planetary gears;

and pins disposed on the first and second arms;

wherein a rotational position of the mode changing gear controls the position of the planetary gears around the sun gear, according to whether or not each of the pins is contacting a corresponding one of the bosses.

3. A thermal transfer type printer according to claim 2, wherein the bosses are formed as arcs having their center at the axis of the mode changing gear.

4. A thermal transfer type printer according to claim 2, wherein further comprising:

two sensor plates having recesses at their peripheral portion;

and a cam for controlling the pressing and separation means;

wherein the rotation axes of the sensor plates, the cam and the mode changing gear are configured so as to form a coaxial structure and rotate together.

5. A thermal transfer type printer according to claim 4, wherein the pressing and separation means comprises:

a link mechanism comprised of three arms;

a first roller disposed at one of the side arms;

and a second roller disposed at the other side arm;

wherein the first roller contacts with an element in the pressing and separation means, the second roller contacts with the cam, so that the pressing and separation can be controlled according to the rotation of the cam.

6. The thermal transfer type printer according to claim 2, wherein when a motor rotates in a forward direction, the operational mode of the the pressing and separation means are selected according to the rotation of the mode changing gear, and when the motor rotates in a reverse direction, opposite the forward direction, a first and second torque transmission paths are adapted for driving by a motor.

7. A thermal transfer type printer according to claim 2, wherein one of the planetary gears is connected with a gear via a one-way clutch mechanism so that torque is transferred through the gear only in a predetermined rotation direction and is not transferred in a reverse direction opposite the predetermined rotation direction.

8. The thermal transfer printer according to claim 1 wherein the different torque transmission paths include:

a first torque transmission path for transmitting torque to the ink ribbon feeder at a first rotational position of the mode changing gear;

a second torque transmission path for moving the printing paper feeder to feed paper in one direction at a second rotational position of the mode changing gear;

a third torque transmission path for moving the printing paper feeder to feed paper in another direction at a third rotational position of the mode changing gear;

and a fourth torque transmission path for transmitting torque to the pressing and separation means at a fourth rotational position of the mode changing gear;

wherein the pressing and separation means, the printing paper feeder, and the ink ribbon feeder are driven commonly by the motor, and the torque transmission path from the motor to them is changed in accordance with the first, second, and third rotational positions of the mode changing gear.

9. A printer comprising:

a platen roller;

a thermal printing head for printing with an ink ribbon between the thermal printing head and the platen roller;

a feeder for feeding paper between the platen roller and the ink ribbon;

a plurality of gears cooperating to provide a plurality of different torque transmission paths to operate at least the platen roller and the feeder;

a first arm and a second arm for changing between the different torque transmission paths by altering an engagement state of the gears; and a mode changing gear having a front surface opposite a rear surface, bosses extending from the front surface and the rear surface for controlling a position and movement of the first and second arms to change the engagement state of the gears.

10. The printer according to claim 9 further comprising:

a sun gear for rotating the mode changing gear;

a pair of planetary gears engaging the sun gear;

the first and second arms extending outward from a rotation axis of the sun gear, at least one of the first and second arms providing a contact state and a disengagement state with respect to a corresponding one of the bosses.

11. The printer according to claim 10 further comprising a grip roller associated with the feeder, one of the planetary gears being adapted to transfer rotational energy in a single rotational direction to the grip roller for paper feeding.

12. The printer according to claim 10 further comprising a feeder for feeding the ink ribbon, the plurality of gears cooperating to provide an additional torque transmission path for operating the feeder for feeding the ink ribbon.

13. The printer according to claim 9 wherein each of the bosses comprises an arcuate projection extending axially from the mode changing gear.

14. The printer according claim 9 further comprising:

a sensor plate adapted to rotate with the mode changing gear;

a detector for detecting a rotational position of the sensor plate to indicate an active one of the different torque transmission paths associated with the mode changing gear.

15. The printer according to claim 9 further comprising a clearance adjuster for adjusting a clearance between the platen roller and the printing head in accordance with a rotational position of the mode changing gear.

16. The printer according to claim 9 wherein the different torque transmission paths include:

a first torque transmission path for transmitting torque to an ink ribbon feeder at a first rotational position of the mode changing gear;

a second torque transmission path for transmitting torque to the paper feeder for feeding paper in one direction at a second rotational position of the mode changing gear;

a third torque transmission path for transmitting torque to the paper feeder for feeding paper in another direction at a third rotational position of the mode changing gear;

and a fourth torque transmission path for transmitting torque to a clearance adjuster at a fourth rotational position of the mode changing gear;

wherein the first, second, third and fourth torque transmission paths are driven commonly by a single motor.

17. The printer according to claim 16 wherein the motor is adapted to rotate in two opposite directions.

* * * * *